US009791248B2

(12) United States Patent
Godfrey

(10) Patent No.: US 9,791,248 B2
(45) Date of Patent: Oct. 17, 2017

(54) DEVICE AND METHOD FOR A DETONATOR WITH IMPROVED FLYER LAYER ADHESION

(71) Applicant: Excelitas Canada, Inc., Vaudreuil-Dorion (CA)

(72) Inventor: Lawrence Godfrey, Vaudreuil-Dorion (CA)

(73) Assignee: Excelitas Canada, Inc., Vaudreuil-Dorion (CA)

( * ) Notice: Subject to any disclaimer, the term of this patent is extended or adjusted under 35 U.S.C. 154(b) by 0 days.

(21) Appl. No.: 15/098,884

(22) Filed: Apr. 14, 2016

(65) Prior Publication Data

US 2016/0305750 A1 Oct. 20, 2016

Related U.S. Application Data

(60) Provisional application No. 62/147,206, filed on Apr. 14, 2015.

(51) Int. Cl.
*F42B 3/10* (2006.01)
*F42B 3/12* (2006.01)
*F42B 3/195* (2006.01)

(52) U.S. Cl.
CPC ..... *F42B 3/124* (2013.01); *F42B 3/195* (2013.01)

(58) Field of Classification Search
CPC ..... F42B 3/124; F42B 3/195
USPC ..... 102/202.5, 202.7, 202.14
See application file for complete search history.

(56) References Cited

U.S. PATENT DOCUMENTS 3,900,803 A 8/1975 Silfvast et al.
4,708,060 A * 11/1987 Bickes, Jr. ..... F42B 3/13 102/202.5
4,788,913 A * 12/1988 Stroud ..... F42B 3/124 102/202.5
4,852,493 A * 8/1989 Boberg ..... F41A 19/63 102/202.5
4,862,803 A * 9/1989 Nerheim ..... F42B 3/13 102/202.5
5,370,053 A * 12/1994 Williams ..... F42C 19/12 102/202.14
5,370,054 A 12/1994 Reams et al.
5,789,697 A * 8/1998 Engelke ..... F42B 3/128 102/202.5
5,969,286 A * 10/1999 Ward ..... F42B 3/124 102/202.14
6,158,347 A * 12/2000 Neyer ..... F42B 3/124 102/202.14
6,178,888 B1 * 1/2001 Neyer ..... F42B 3/124 102/202.14

(Continued)

*Primary Examiner* — Samir Abdosh
(74) *Attorney, Agent, or Firm* — Peter A. Nieves; Sheehan Phinney Bass & Green PA

(57) ABSTRACT

A chip slapper is presented, having a substrate, a conductive layer disposed above the substrate face, and an intermediate layer disposed between the substrate face and the conductive layer. The conductive layer and intermediate layer form a first land and a second land atop the substrate face, with a bridge formed of the intermediate layer spanning between the first land and the second land. A first adhesion portion is attached to the first land, and a second adhesion portion is attached to the second land, wherein at least a portion of the bridge is not overlaid by the first adhesion portion or the second adhesion portion.

29 Claims, 9 Drawing Sheets

(56) References Cited

U.S. PATENT DOCUMENTS

| | | | | |
|---|---|---|---|---|
| 6,230,625 | B1 | 5/2001 | Neyer et al. | |
| 6,234,081 | B1 * | 5/2001 | Neyer | F42B 3/124 102/200 |
| 6,374,739 | B1 | 4/2002 | Smith et al. | |
| 6,470,802 | B1 * | 10/2002 | Neyer | F42B 3/124 102/202.5 |

* cited by examiner

DEVICE AND METHOD FOR A DETONATOR WITH IMPROVED FLYER LAYER ADHESION

CROSS-REFERENCE TO RELATED APPLICATIONS

This application claims the benefit of U.S. Provisional Patent Application Ser. No. 62/147,206, filed Apr. 14, 2015, entitled "Device and Method for a Detonator with Improved Polyimide Adhesion," which is incorporated by reference herein in its entirety.

FIELD OF THE INVENTION

The present invention relates to explosives, and more particularly, is related to a detonator device.

BACKGROUND OF THE INVENTION

Slapper type detonators in general cause a "flying plate" or "flyer layer" to be propelled at a high velocity against a secondary explosive medium creating a shock wave which results in the detonation of the secondary explosive. In a typical design, there are two wide area conductive lands separated by a narrow rectangular bridge member. The lands are connected to a capacitor through a high voltage switch. When the switch closes, the capacitor provides current across the lands which vaporizes the bridge member turning it into a plasma. This plasma accelerates a portion of the dielectric material covering the bridge member, the flying plate or flyer layer, to a high velocity, causing the flying plate or flyer layer to slap into an explosive. The resulting shock wave causes detonation of the explosive. This type of detonator is also known as a "chip slapper detonator."

FIGS. 1 through 3 show diagrams illustrating the production process for a prior art chip slapper. In FIGS. 1 through 3 the thickness of the relative layers are exaggerated for the purposes of illustration.

Manufacturing may begin with a wafer 60, FIG. 1 which includes a ceramic substrate layer 62, a sticking layer 64, for example, titanium tungsten, a first conductive layer 66, for example, copper, a buffer layer 68, and a second conductive layer 70, for example, a gold coating. The buffer layer 68 may be, for example, a titanium-tungsten composition. The buffer layer 68 may retard or prevent inter-diffusion between copper of the first conductive layer 66 and the second conductive layer 70. Similarly, forming the second conductive layer 70 of gold may promote solder-ability of land areas 42, 44 (FIG. 2).

The wafer 60 may be used to fabricate one or more chip slappers 46. First, for each chip slapper 46, the second conductive layer 70, the buffer layer 68, the copper conductive layer 66, and the sticking layer 64 may be etched as shown in FIG. 2 to form wide land areas (lands) 42 and 44 and a narrow bridge portion 50 spanning between the lands 42, 44. In FIG. 2, only one chip slapper 46 is shown but it is to be understood that wafer 60, (FIG. 1) may be used to produce a number of chip slappers 46 as shown in FIG. 2.

After the lands 42, 44 and the bridge 50 have been etched, the second conductive layer 70 is etched off the bridge portion 50 to expose buffer material 68 as shown in FIG. 3. A non-conductive flyer layer, for example, a dielectric coating such as polyimide or Kapton® layer, 52 is secured to the bridge portion 50 of each chip slapper 46. Each individual chip slapper 46 may be cut from the wafer 60 (FIG. 1).

Thus, the chip slapper 46 includes a substrate 54 formed of the ceramic substrate layer 62, the sticking layer 64 on the substrate 54, the conductive layer 66 on the sticking layer 64 in the shape of lands 42 and 44 separated by a bridge portion 50 between the lands 42 and 44. In alternative embodiments, the substrate 54 may be formed of other materials, for example, sapphire, silicon nitride, synthetic diamond, beryllium, or silicon with an oxide layer on top, among others.

The bridge 50 is formed from an exposed portion of the buffer layer 68, and disposed upon the conductive layer 66. The second conductive layer 70 is disposed over the buffer layer 68. The second conductive layer 70, as explained above, typically extends across and forms an exposed surface of at least a substantial portion of the lands 42 and 44, but may be absent from all or a substantial portion of the bridge portion 50. The flyer layer 52 is then placed over the bridge portion 50. The buffer material 68 acts to prevents migration of the second conductive layer 70 into the material of the conductive layer 66 and vice versa. The buffer material 68 also acts to better adhere the flyer layer 52 on bridge portion 50 where the second conductive layer 70 is absent.

FIG. 4A is a top view of the diagram of FIG. 3 with the flyer layer 52 removed for clarity. FIG. 4B is a top view similar to FIG. 4A with the flyer layer 52 shown in circular dashed lines to indicate areas of adhesion inside the region bounded by circular dashed lines. The flyer layer 52 adheres to the substrate 54 in first adhesion regions 81. The flyer layer adheres to the bridge 50 in a second adhesion region 82. The flyer layer 52 adheres to the lands 42, 44 in third adhesion regions 83. The flyer layer 52 adheres to the bridge portion 50 in the adhesion region 82.

In use, the lands 42, 44 are connected to a suitable current source (not shown). When sufficient current, for example, several hundreds of amps, is applied through the lands 42, 44, the bridge member 50 vaporizes and is turned into a plasma. This plasma accelerates a portion of flyer layer 52 ("the flying plate") away from the substrate 54 and towards an explosive (not shown). The shock of the flyer layer 52 striking the explosive detonates the explosive.

In general, the dielectric material forming the flyer layer 52 adheres well to the ceramic substrate 54 in the first adhesion regions 81, and to the bridge 50 formed from the buffer material 68 (FIG. 3) in the second adhesion region 82. However, since the lands 42, 44 are generally formed of a material selected for solder-ability, the dielectric material forming the flyer layer 52 may not adhere consistently to the lands 42, 44 in the third region 83, leading to variability of performance of the chip slapper 46. Furthermore, in chip slappers 46 where the exposed bridge portion 50 is formed of a conductor material, for example, if the buffer material 68 is omitted or if the second conductive layer 70 is not removed from the bridge 50, the dielectric material forming the flyer layer 52 may not adhere consistently to the bridge 50 in the second region 82. Therefore, there is a need in the industry to overcome the abovementioned shortcomings.

SUMMARY OF THE INVENTION

Embodiments of the present invention provide devices and methods for a chip slapper with improved flyer layer adhesion. Briefly described, the present invention is directed to a chip slapper having a substrate, a conductive layer disposed above the substrate face, and an intermediate layer disposed between the substrate face and the conductive layer. The conductive layer and intermediate layer form a first land and a second land atop the substrate face, with a bridge formed of the intermediate layer spanning between the first land and the second land. A first adhesion portion is attached to the first land, and a second adhesion portion is attached to the second land, wherein at least a portion of the bridge is not overlaid by the first adhesion portion or the second adhesion portion.

Other systems, methods and features of the present invention will be or become apparent to one having ordinary skill in the art upon examining the following drawings and detailed description. It is intended that all such additional systems, methods, and features be included in this description, be within the scope of the present invention and protected by the accompanying claims.

BRIEF DESCRIPTION OF THE DRAWINGS

The accompanying drawings are included to provide a further understanding of the invention, and are incorporated in and constitute a part of this specification. The components in the drawings are not necessarily to scale, emphasis instead being placed upon clearly illustrating the principles of the present invention. The drawings illustrate embodiments of the invention and, together with the description, serve to explain the principals of the invention.

DETAILED DESCRIPTION

Figure 1:
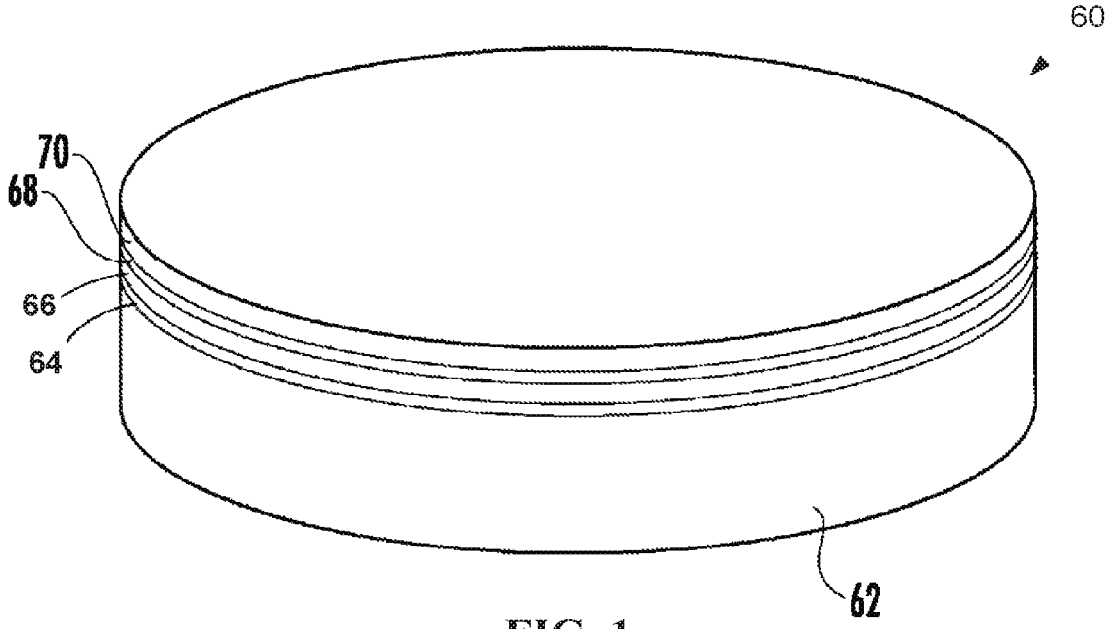
FIG. 1 (PRIOR ART)
FIG. 1 is a schematic view of a multi-layer wafer used to manufacture a number of prior art chip slappers.
Figure 2:
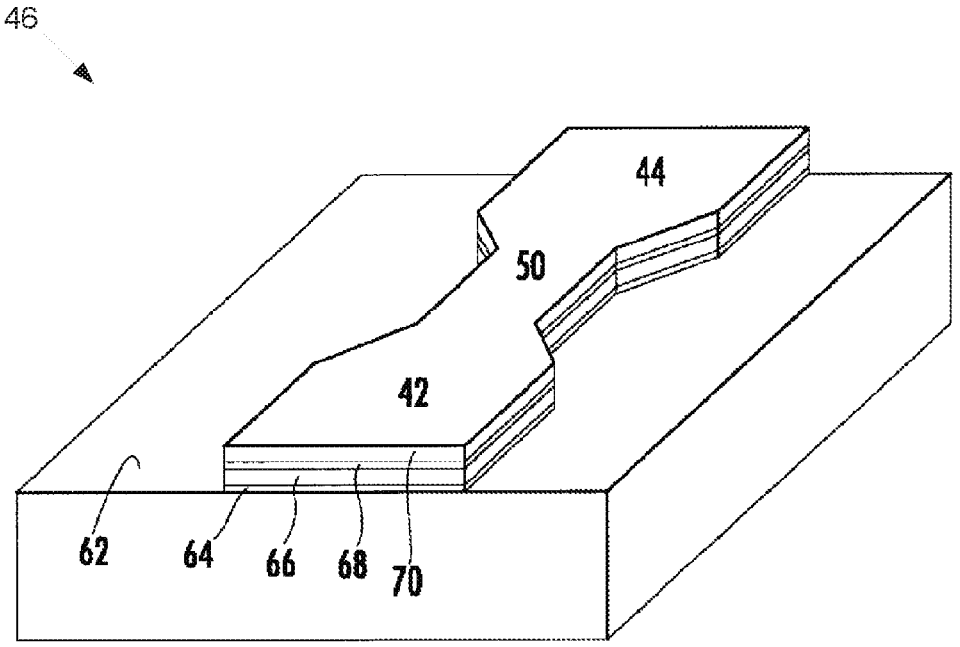
FIG. 2 (PRIOR ART)
FIG. 2 is a schematic view of a portion of the prior art wafer shown in FIG. 1 after the metal layers are etched to form the conductive lands and the bridge portion of an individual prior art chip slapper.
Figure 3:
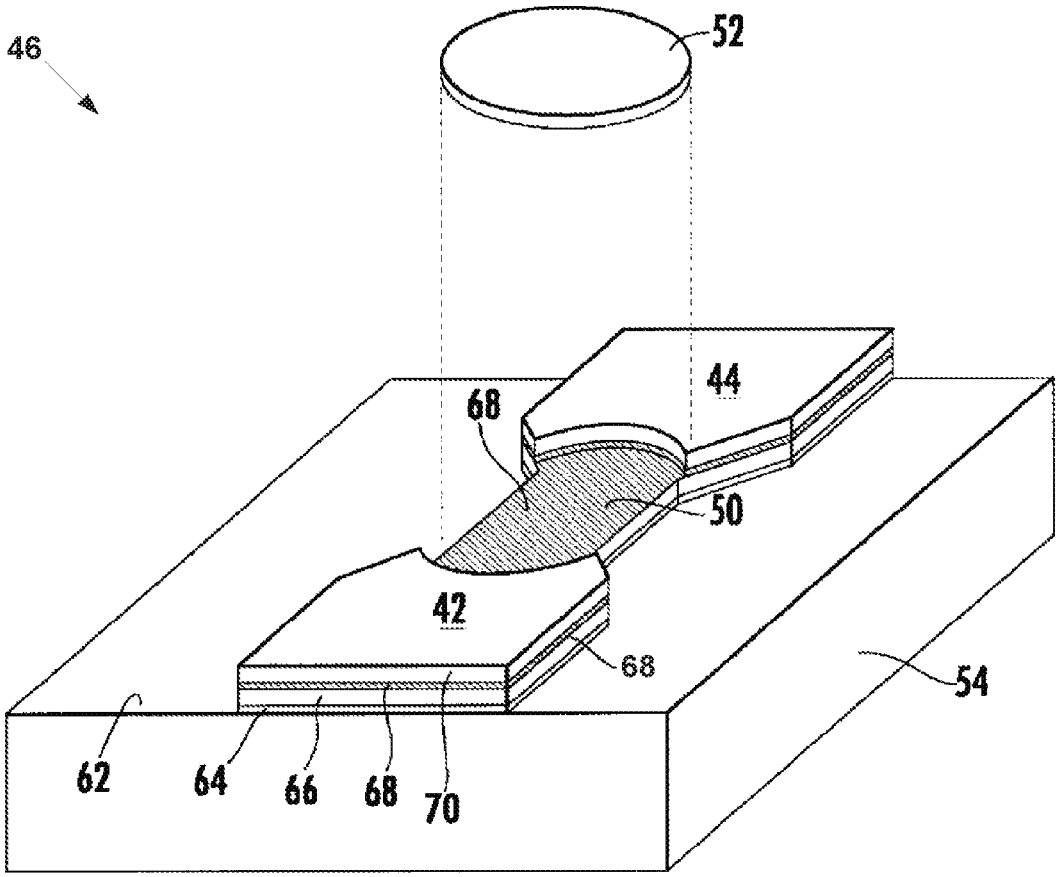
FIG. 3 (PRIOR ART)
FIG. 3 is schematic view of a portion of the prior art wafer shown in FIG. 2 with the gold coating removed from the bridge portion of the prior art chip slapper.
Figure 4A:
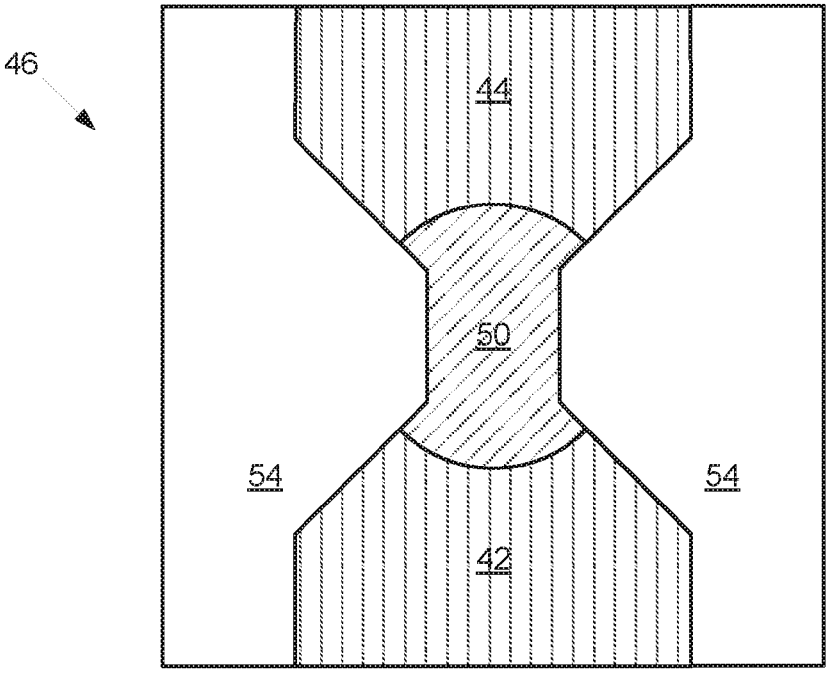
FIG. 4A (PRIOR ART)
FIG. 4A is a top view similar to FIG. 3 with the flyer layer removed for clarity.
Figure 4B:
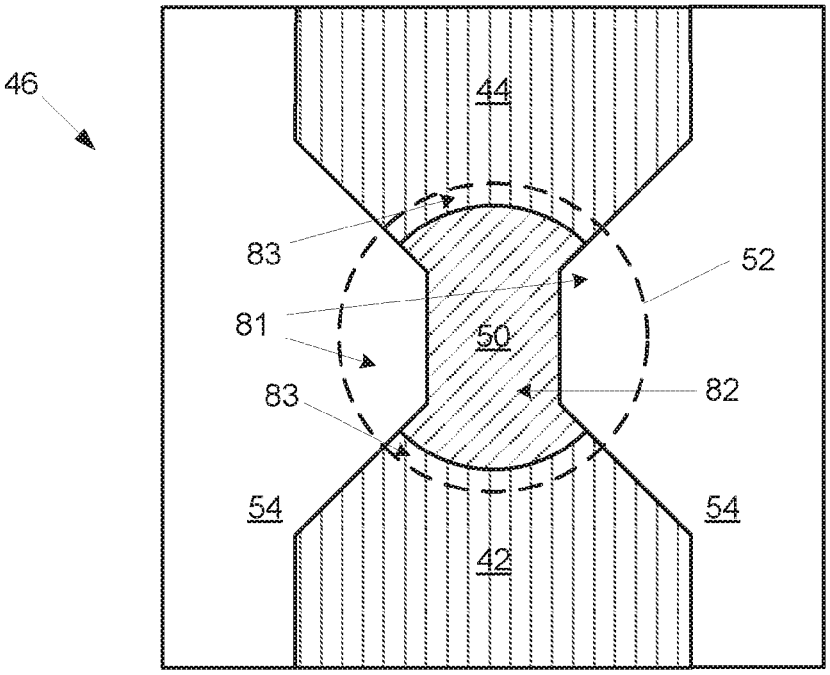
FIG. 4B (PRIOR ART)
FIG. 4B is a top view similar to FIG. 4A with the flyer layer location shown in dashed lines.

The following definitions are useful for interpreting terms applied to features of the embodiments disclosed herein, and are meant only to define elements within the disclosure.

As used within this disclosure, an "exposed" area refers to a region of substrate or a layer of material layered above the substrate where a subsequent adjacent layer (or a portion thereof) has been removed, for example, by etching.

As used within this disclosure "substantially" means, very nearly, or within typical manufacturing tolerances as would be appreciated by a person having ordinary skill in the art. For example, "substantially contiguous" indicates continuity between two elements despite insignificant gaps that do not generally affect the function of the elements.

Reference will now be made in detail to embodiments of the present invention, examples of which are illustrated in the accompanying drawings. Wherever possible, the same reference numbers are used in the drawings and the description to refer to the same or like parts.

Figure 5:
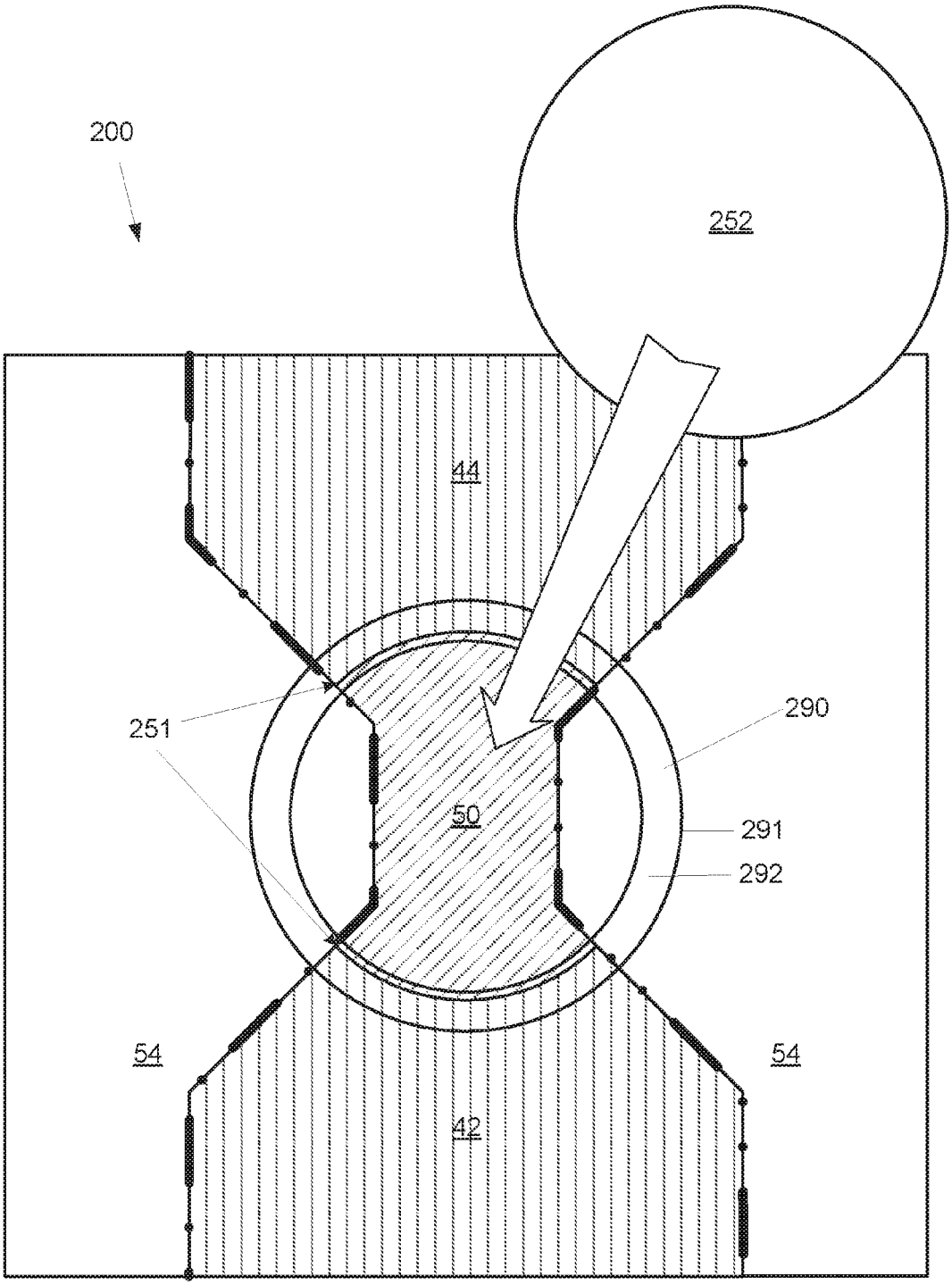
FIG. 5 is a schematic diagram of a top view of an exemplary first embodiment of a chip slapper detonator.

FIG. 5 is a schematic diagram of a top view of an exemplary first embodiment of a chip slapper 200. The first embodiment may be initially formed from the wafer 60 of FIG. 1, having a ceramic substrate layer 62, a sticking layer 64, for example, titanium tungsten, a conductive layer 66, for example, copper, a buffer layer 68, and a second conductive layer 70, for example, a gold coating. The buffer layer 68 may be, for example, a titanium-tungsten or nickel composition. While the wafer 60 is shown for illustrative purpose for the first embodiment, wafers having different compositions are also possible. For example, the buffer layer 68 or other layers of the wafer 60 may be omitted, and other layers not shown in FIG. 60 may be included, for example, additional buffer layers and/or sticking layers.

As shown in FIG. 5, a first land 42, a second land 44 and a bridge 50 spanning the first land 42 and the second land 44 may be formed by removing the layers above the substrate 54, for example, by etching, exposing the substrate 54. The first land 42, the second land 44, and bridge 50 are positioned between and separate two exposed surface regions of the substrate 54. The first land 42, the second land 44, and the bridge 50 therefore each include a first edge (dash-dot line) defining a first boundary from a first exposed portion the substrate 54 and a second edge (dash-dot dot line) defining a second boundary from a second exposed portion of the substrate 54.

Unlike the prior art (FIGS. 1-4), an adhesion layer 290 (or "adhesion portion") is applied over the first land 42, the second land 44, the bridge 50, and the substrate 54. Under the first embodiment, the adhesion layer 290 may be formed in a ring shape, having an inner edge 292 with a first radius and an outer edge 291 with a second radius, where the second radius is larger than the first radius. The adhesion layer 290 may overlay an interface edge 251 between the material forming the surface of the first land 42 a, for example, gold, and the material forming the surface of the bridge 50, for example, copper or a titanium-tungsten composition and also overlay an interface edge 251 between the material forming the second land 44, for example, gold, and the material forming the surface of the bridge 50, for example, copper or a titanium-tungsten composition.

In general, the adhesion layer 290 preferably does not cover most or all of the bridge 50. In particular, it is desirable, that the adhesion layer 290 is absent over portions of the bridge 50 where the flyer layer 52 is intended to separate upon detonation. In alternative embodiments, the adhesion layer 290 may not overlay any portion of the bridge 50.

The adhesion layer 290 is generally formed of a material conducive for adhesion to a dielectric coating such as polyimide or a Kapton® layer. For example, the adhesion layer 290 may be formed of a metal oxide of titanium, tungsten, titanium-tungsten, or chromium. Other metal oxides with good adhesive characteristics may also be used. Typically, gold is an undesirable material for the adhesion layer 290, in part since gold does not make a good oxide. When formed as a ring shape, or otherwise when the portion of the adhesion layer 290 above the first land 42 is contiguous with the portion of the adhesion layer 290 above the second land 44, as per the first embodiment, the adhesion layer 290 is preferably formed of a material that is not electrically conducting such as, but not limited to, silicon oxides.

A flyer layer 252 overlays the adhesion layer 290, as well as the entirety of the bridge 50. The flyer layer 252 may also overlay a portion of the exposed portions of the substrate 54, as well as a portion of the first land 42 and the second land 44. For example, an outside radius of the flyer layer 252 is generally larger than the radius of the inner edge 292 of the adhesion layer 290, and the outside radius of the flyer layer 252 may be less than, equal to, or larger than the larger radius of the outer edge 291 of the adhesion layer 290. In a preferred embodiment, the outside radius of the flyer layer 252 may be slightly smaller than the radius of the outer edge 291, for example, in the range of 1 to 1000 microns smaller.

In general, a significant portion of the first land 42 and the second land 44, are left exposed, and not covered by the flyer layer 252, for example, half or more of the first land 42 and half or more of the second land 44. The exposed portions of the first land 42 and/or the second land 44 may be used as electrical connection points or pads, for example, for soldering leads or other electrical components. The flyer layer 252 may include a dielectric coating such as polyimide or Kapton®.

Preferably, the shape of the adhesion layer 290 conforms to the shape of all or a portion of the flyer layer 252, which is applied over the adhesion layer 290. Under the first embodiment, the flyer layer 52 is circular, and the adhesion layer 290 is ring shaped, conforming to the shape of the flyer layer 252. However, the flyer layer 252 need not be circular. For example, in alternative embodiments, the flyer layer 252 may be rectangular. Further, the flyer layer 252 may be irregularly shaped, for example, having a rectangular profile for a portion covering the first land 42, and a circular profile for a portion covering the second land 44, among other possible configurations. A conforming shape of the adhesion layer 290 to the shape of the flyer layer 252 may facilitate cleaner separation of some or all of the flyer layer 252.

Figure 6:
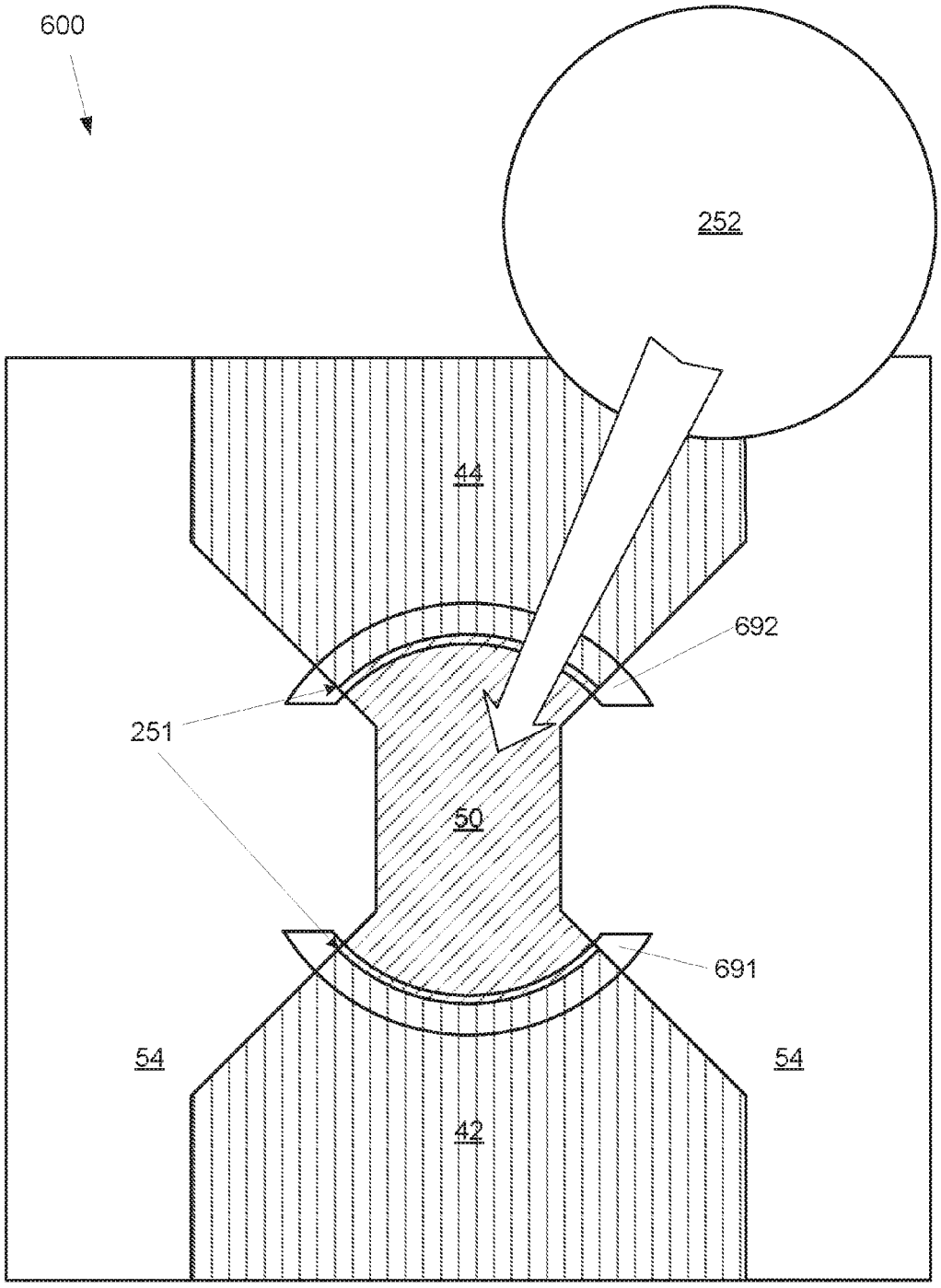
FIG. 6 is a schematic diagram of a top view of an exemplary second embodiment of a chip slapper detonator.

FIG. 6 is a schematic diagram of a top view of an exemplary second embodiment of a chip slapper 600. Like the first embodiment, the second embodiment may be initially formed from the wafer 60 of FIG. 1, having a ceramic substrate layer 62, a sticking layer 64, a conductive layer 66, a buffer layer 68, and a second conductive layer 70, for example, a gold coating. While the wafer 60 (FIG. 1) is shown for illustrative purpose for the second embodiment, wafers having different compositions are also possible. For example, the buffer layer 68 or other layers of the wafer 60 may be omitted, and other layers not shown in FIG. 6 may be included, for example, additional buffer layers and/or sticking layers. As shown in FIG. 5, a first land 42, a second land 44, and a bridge 50 spanning the first land 42 and the second land 44 may be formed by removing the layers above the substrate 54, for example, by etching, exposing the substrate 54. The first land 42, the second land 44, and the bridge 50 are positioned between and separate two exposed surface regions of substrate 54.

Unlike the first embodiment, where an adhesion layer 290 is applied over the first land 42, the second land 44, the bridge 50, and the substrate 54, under the second embodiment a first adhesion portion 691 is applied over the first land 42, and a second adhesion portion 692 is applied over the second land 44.

Under the second embodiment, the first adhesion portion 691 and the second adhesion portion may be formed as arc shaped portions. The adhesion portions 691, 692 may overlay an interface edge 251 between the material forming the surface of the first land 42 and the second land 44, for example, gold, and the material forming the surface of the bridge 50, for example, copper or a titanium-tungsten composition, and also overlay an interface edge 251 between the material forming the second 44, for example, gold, and the material forming the surface of the bridge 50, for example, copper or a titanium-tungsten composition.

Figure 8:
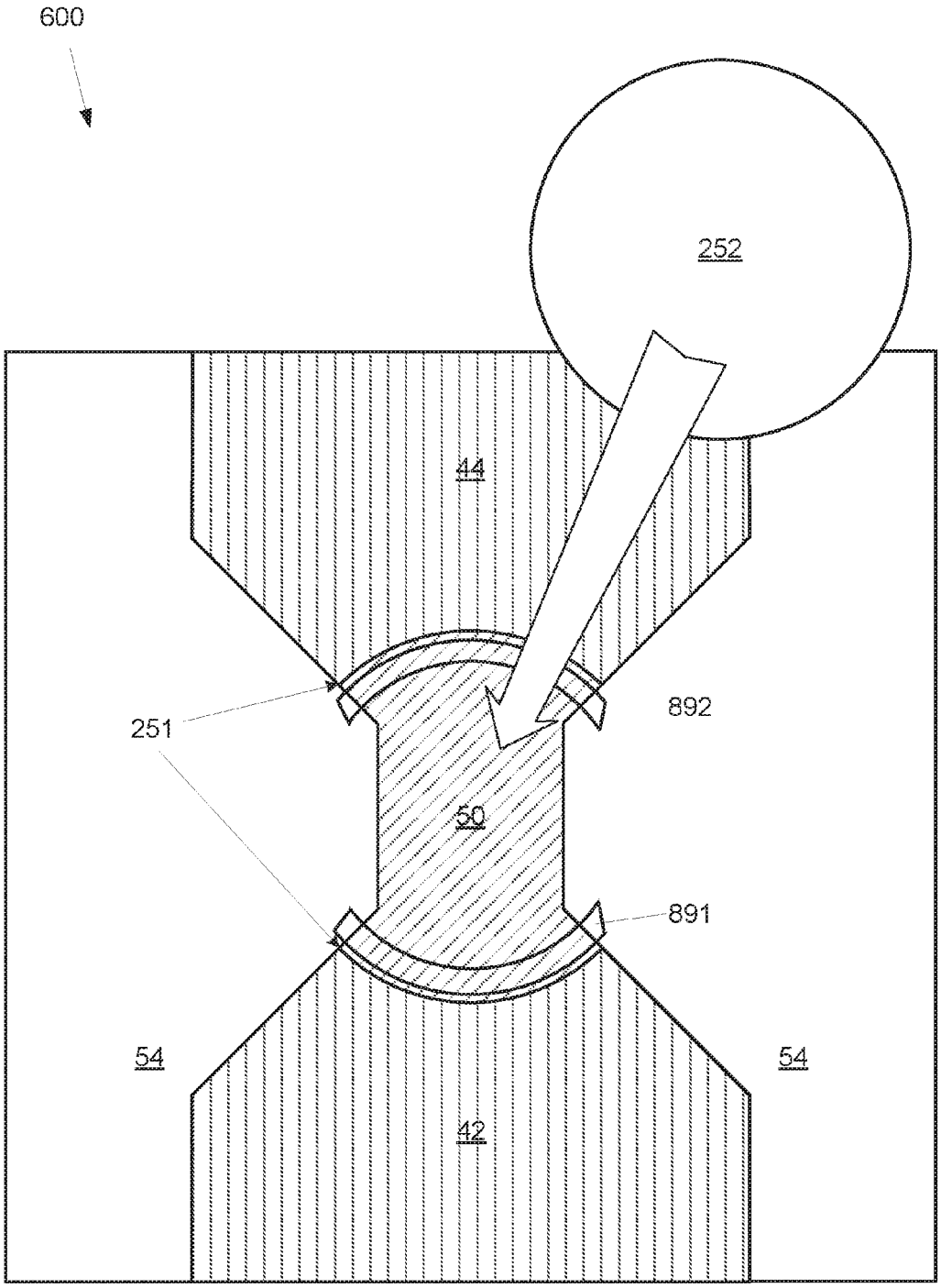
FIG. 8 is a schematic diagram of a top view of an exemplary third embodiment of a chip slapper detonator.
Figure 9:
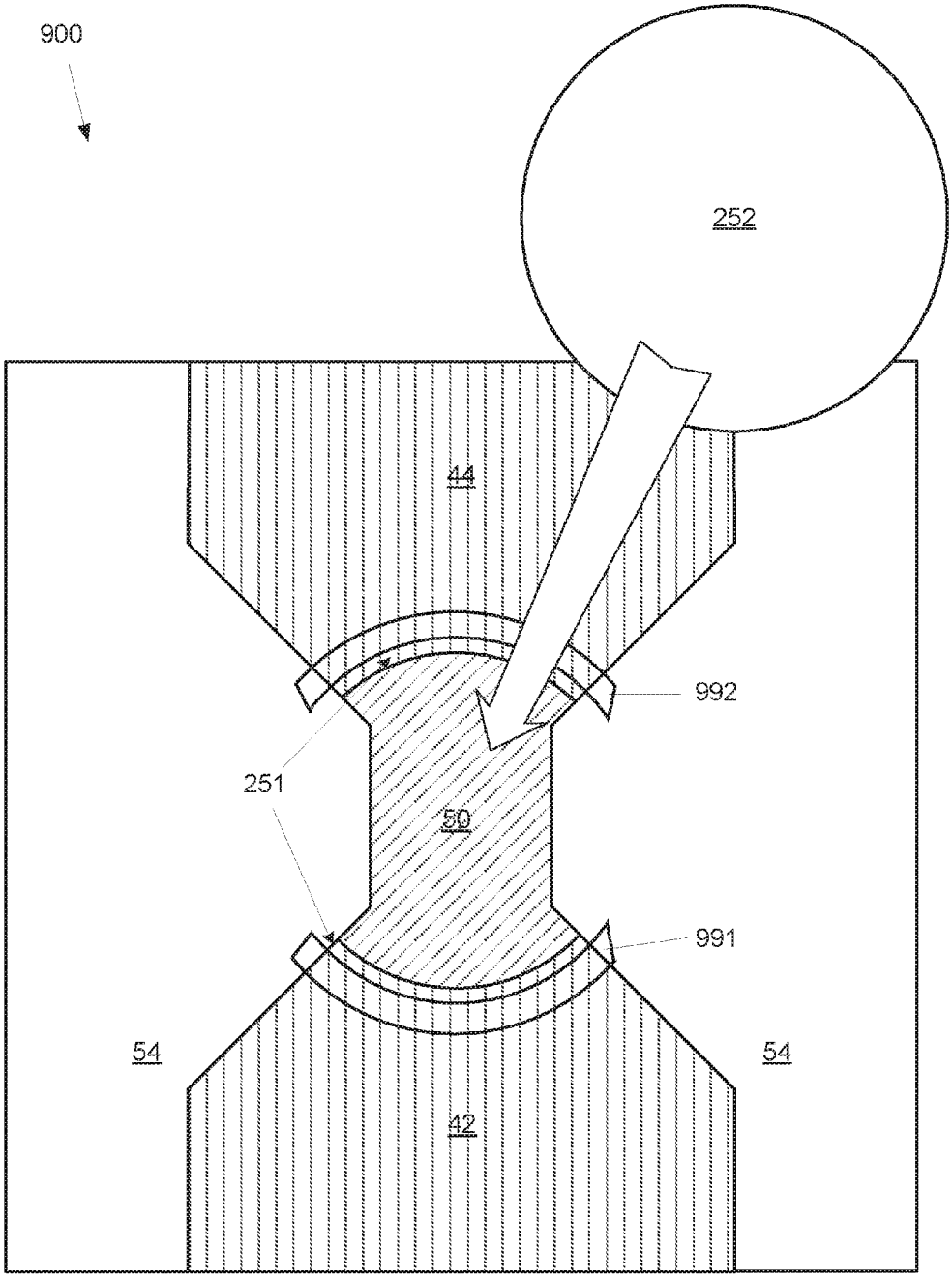
FIG. 9 is a schematic diagram of a top view of an exemplary fourth embodiment of a chip slapper detonator.

In addition, the adhesion portions 691, 692 may extend to overlay a portion of the substrate 54. However, in alternative embodiments the adhesion portions 691, 692 may not extend past the interface between the bridge 50 and the first land 42 and the second land 44 over the substrate 54. In a third exemplary embodiment 800 shown by FIG. 8, the adhesion portions 891, 892 may overlay the material forming the surface of the bridge 50, and not overlay the material forming the surface of the first land 42 and the second land 44. In a fourth exemplary embodiment 900 shown in FIG. 9, adhesion portions 991, 992 may overlay only the material forming the surface of the first land 42 and the second land 44, for example gold, and not overlay the material forming the surface of the bridge 50.

Returning to FIG. 6, in general, the adhesion portions 691, 692 preferably do not cover most or all of the bridge 50. In particular, it is desirable, that adhesion portions 691, 692 are absent over portions of the bridge 50 where all or a portion of the flyer layer 52 is intended to separate from the chip slapper 600 upon activation.

The adhesion portions 691, 692, 891, 892, 991, 992 are generally formed of a material conducive for adhesion to a dielectric layer, for example, polyimide or Kapton®. For example, the adhesion portions 691, 692, 891, 892, 991, 992 may be formed of a metal oxide of titanium, tungsten, titanium-tungsten, or chromium. Other metal oxides with good adhesive characteristics may also be used. Typically, gold is an undesirable material for the adhesion portions 691, 692, 891, 892, 991, 992, for example, in part since gold does not make a good oxide. Since the adhesion portions 691, 692, 891, 892, 991, 992 are not contiguous, in contrast with the first embodiment described above, the adhesion portions 691, 692, 891, 892, 991, 992 may be formed of a material that is electrically conducting.

A flyer layer 252 overlays the adhesion portions 691, 692, 891, 892, 991, 992, as well as the entirety of the bridge 50. The flyer layer 252 may also overlay an exposed portion of the substrate 54, as well as a portion of the first land 42 and the second land 44. As with the first embodiment, in general, a significant portion of the first land 42 and the second land 44, are left exposed, and not covered by the flyer layer 252, for example, half or more of the first land 42 and the second land 44. The exposed portions of the first land 42 and the second land 44 may be used as electrical connection points or pads, for example, for soldering leads or other electrical components. The flyer layer 252 may be a dielectric coating such as polyimide or Kapton®. Preferably, the shape of the adhesion portions 691, 692, 891, 892, 991, 992 conforms to the shape of the flyer layer 252, which is applied over the adhesion portions 691, 692, 891, 892, 991, 992.

Under the first, second, third and fourth embodiments, the adhesion of the dielectric material of the flyer layer 252 to the substrate 54 is improved over the prior art (FIGS. 1-4) without significantly changing, compared to prior art described in the Background section, the mechanical/thermal/electrical or other characteristics of the flyer layer 252 in the critical central area of the bridge 50 where the flyer layer 252 is heated by an electrical current.

The chip slapper 200 of the first embodiment, the chip slapper 600 of the second embodiment, the chip slapper 800 of the third embodiment, and the chip slapper 900 of the fourth embodiment may be incorporated into other detonator or explosive devices. For example, by adding additional layers over the chip slapper 200 of the first embodiment, the chip slapper 600 of the second embodiment, the chip slapper 800 of the third embodiment, and the chip slapper 900 of the fourth embodiment.

Figure 7:
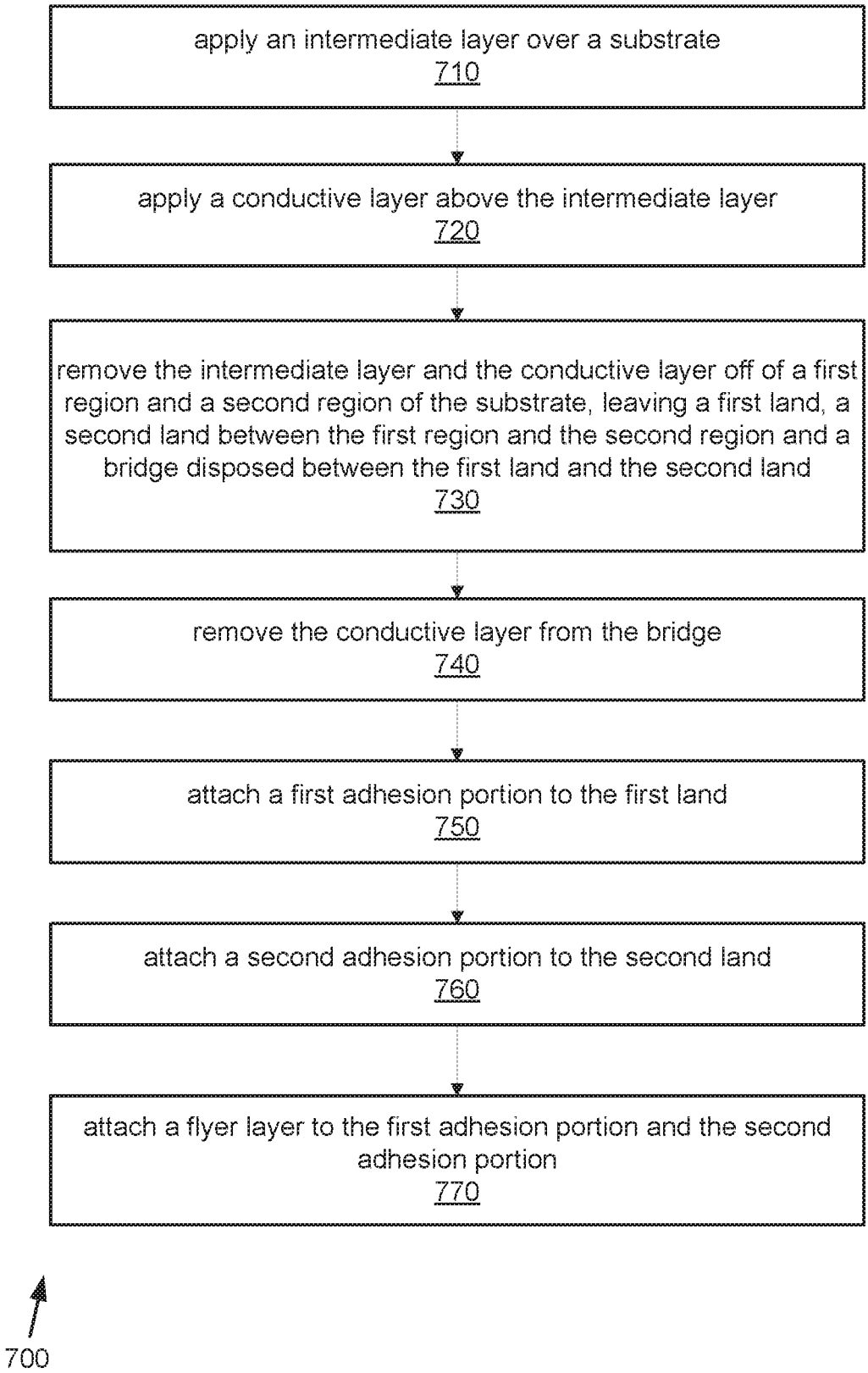
FIG. 7 is a flowchart of a method for forming a chip slapper detonator.

FIG. 7 is a flowchart 700 showing an exemplary method for forming a chip slapper for a detonator device. It should be noted that any process descriptions or blocks in flowcharts should be understood as representing modules, segments, portions of code, or steps that include one or more instructions for implementing specific logical functions in the process, and alternative implementations are included within the scope of the present invention in which functions may be executed out of order from that shown or discussed, including substantially concurrently or in reverse order, depending on the functionality involved, as would be understood by those reasonably skilled in the art of the present invention.

An intermediate layer is applied over an exposed surface portion of a substrate 54 (FIG. 6), as shown by block 710. The intermediate layer may be, for example, a conductive layer or a buffer layer 68 (FIG. 3), or a composite of a buffer layer and a conductive layer. The substrate 54 may be, for example, a ceramic substrate. A conductive layer 70 (FIG. 3), is applied above the intermediate layer, as shown by block 720. For example, the conductive layer may be a gold coating layer, or another electrically conductive material that provides a surface conducive to soldering. The intermediate layer and the conductive layer are removed from of a first region and a second region of the substrate 54 (FIG. 6), for example by etching, leaving a first land 42 (FIG. 6), a second land 44 (FIG. 6), between the first region and the second region, as well as a bridge 50 (FIG. 6) disposed between the first land 42 (FIG. 6) and the second land 44, as shown by block 730.

The conductive layer is removed from the bridge (FIG. 6), as shown by block 740, for example, by etching. A first adhesion portion 691 (FIG. 6) is attached to the first land 42 (FIG. 6), as shown by block 750. A second adhesion portion 692 (FIG. 6) is attached to the second land, as shown by block 760. The first adhesion portion 691 (FIG. 6) and the second adhesion portion 692 (FIG. 6) may be attached, for example, by applying a layer of adhesive material over the underlying materials, and then etching the adhesive material to form a ring or two annular arcs. Alternatively, the first adhesion portion 691 (FIG. 6) and the second adhesion portion 692 (FIG. 6) may be applied with a lift-off procedure, or the first adhesion portion 691 (FIG. 6) and the second adhesion portion 692 (FIG. 6) may be deposited using a mask. The first adhesion portion 691 (FIG. 6) and the second adhesion portion 692 (FIG. 6) may also be attached by other means familiar to persons having ordinary skill in the art. A flyer layer 252 (FIG. 6) is attached to the first adhesion portion 691 (FIG. 6) and the second adhesion portion 692 (FIG. 6), as shown by block 770. In general, the first adhesion portion 691 (FIG. 6) and the second adhesion portion 692 (FIG. 6) serve to avoid variation of performance among chip slapper devices.

Figure 10:
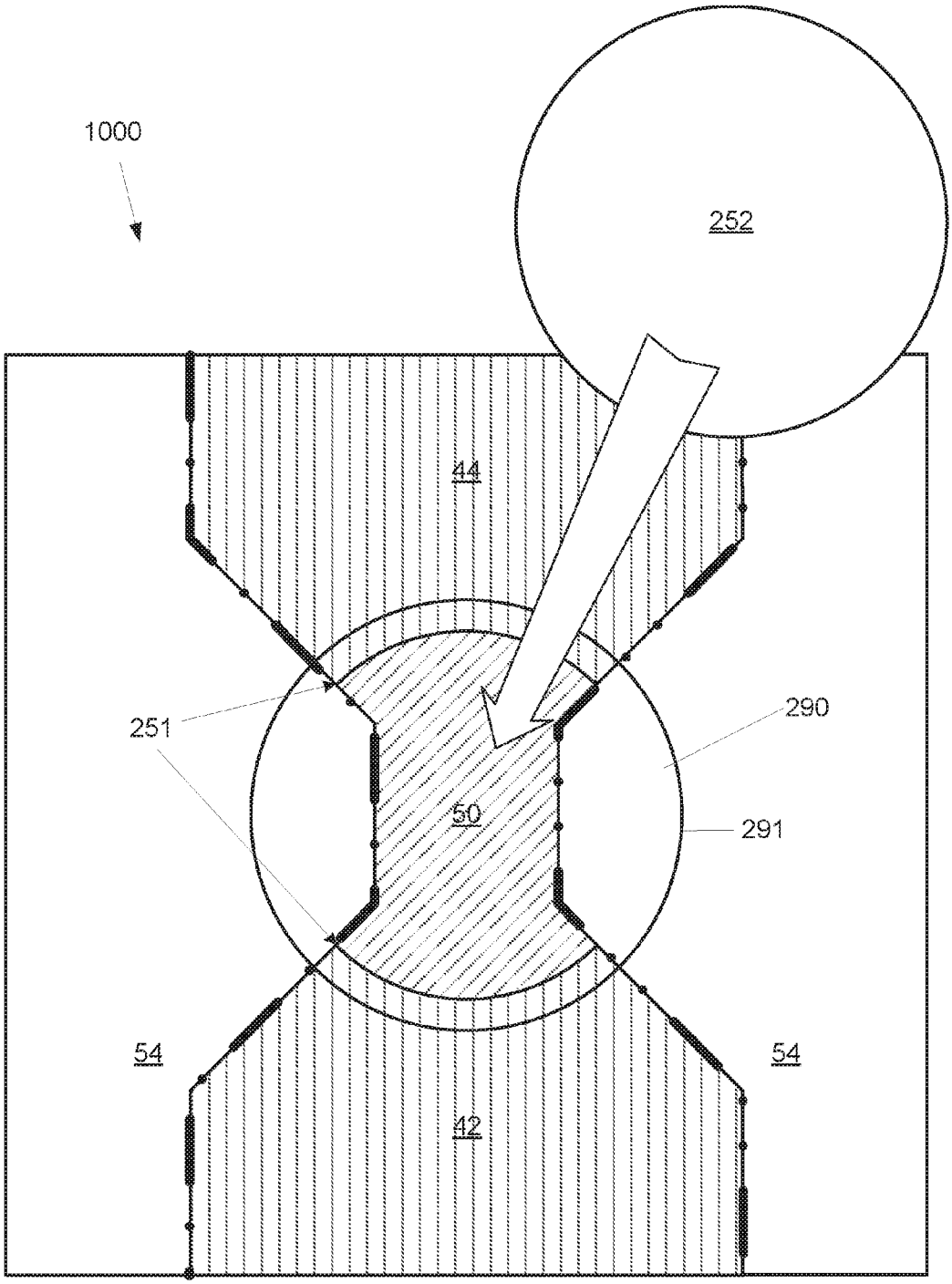
FIG. 10 is a schematic diagram of a top view of an alternative embodiment of a chip slapper detonator.

It will be apparent to those skilled in the art that various modifications and variations can be made to the structure of the present invention without departing from the scope or spirit of the invention. For example, FIG. 10 shows an alternative embodiment 1000 based on the first embodiment shown in FIG. 5, where the adhesion layer 290 may be formed in a circle shape, rather than a ring shape. In view of the foregoing, it is intended that the present invention cover modifications and variations of this invention provided they fall within the scope of the following claims and their equivalents.

What is claimed is:

1. A chip slapper, comprising:

a substrate comprising a back and a face substantially opposite the back;

a conductive layer disposed above the substrate face;

an intermediate layer disposed between the substrate face and the conductive layer;

a first land comprising the intermediate layer, and the conductive layer, a first edge adjacent to a first region of the substrate that is covered by neither the intermediate layer nor the conductive layer, and a second edge adjacent to a second region of the substrate that is covered by neither the intermediate layer nor the conductive layer;

a second land comprising the intermediate layer and the conductive layer, a first edge adjacent to the first region of substrate, and a second edge adjacent to the second region of substrate;

a bridge disposed between the first land and the second land comprising the intermediate layer and omitting the conductive layer, a first edge adjacent to the first region of substrate, and a second edge adjacent to the second region of substrate;

a first adhesion portion disposed over the first land and spanning between the first region of substrate and the second region of substrate; and a second adhesion portion disposed over the second land spanning between the first region of substrate and the second region of substrate, wherein at least a portion of the bridge spanning the first edge and the second edge is not overlaid by the first adhesion portion or the second adhesion portion.

2. The chip slapper of claim 1, further comprising a flyer layer adhered to the first adhesion portion and the second adhesion portion, disposed above the bridge relative to the substrate face, wherein the flyer layer spans the first land and the second land.

3. The chip slapper of claim 1, wherein the first adhesion portion and/or the second adhesion portion overlays a portion of the bridge.

4. The chip slapper of claim 1, wherein the intermediate layer comprises copper.

5. The chip slapper of claim 1, wherein the conductive layer comprises gold.

6. The chip slapper of claim 1, wherein the substrate comprises a ceramic material.

7. The chip slapper of claim 1, wherein the flyer layer comprises a polyimide material.

8. The chip slapper of claim 1, wherein the first and/or second adhesion portion comprises a metal oxide.

9. The chip slapper of claim 1, wherein the first and/or second adhesion portion comprises an electrical conductor.

10. The chip slapper of claim 1, wherein the first edges of the first land, the bridge, and the second land are substantially contiguous, and the second edges of the first land, the bridge, and the second land are substantially contiguous.

11. The chip slapper of claim 1, wherein the first adhesion portion and/or the second adhesion portion overlay a portion of the first substrate region and/or the second substrate region.

12. The chip dapper of claim 11, wherein the first adhesion portion and the second adhesion portion are substantially contiguous.

13. The chip slapper of claim 12, wherein the first adhesion portion and/or the second adhesion portion are formed of a non-conductive material.

14. The chip slapper of claim 1, further comprising a buffer layer disposed between the intermediate layer and the conductive layer.

15. A chip slapper, comprising:

a substrate comprising a back and a face substantially opposite the back;

a conductive layer disposed above the substrate face;

an intermediate layer disposed between the substrate face and the conductive layer;

a first land comprising the intermediate layer, and the conductive layer, a first edge adjacent to a first region of the substrate that is covered by neither the intermediate layer nor the conductive layer, and a second edge adjacent to a second region of the substrate that is covered by neither the intermediate layer nor the conductive layer;

a second land comprising the intermediate layer and the conductive layer, a first edge adjacent to the first region of substrate, and a second edge adjacent to the second region of substrate;

a bridge disposed between the first land and the second land comprising the intermediate layer and omitting the conductive layer, a first edge adjacent to the first region of substrate, and a second edge adjacent to the second region of substrate;

a first adhesion portion disposed over a first portion of a material forming an upper surface of the bridge adjacent to the first land and spanning between the first region of substrate and the second region of substrate;

a second adhesion portion disposed over a second portion of a material forming an upper surface of the bridge adjacent to the second land and spanning between the first region of substrate and the second region of substrate; and a flyer layer adhered to the first adhesion portion and the second adhesion portion, disposed above the bridge relative to the substrate face, wherein the flyer layer spans the first land and the second land.

16. The chip slapper of claim 15, wherein at least a portion of the bridge spanning the first edge and the second edge is not overlaid by the first adhesion portion or the second adhesion portion.

17. A chip slapper, comprising:

a substrate comprising a back and a face substantially opposite the back;

a conductive layer disposed above the substrate face;

an intermediate layer disposed between the substrate face and the conductive layer;

a first land comprising the intermediate layer, and the conductive layer, a first edge adjacent to a first region of the substrate that is covered by neither the intermediate layer nor the conductive layer, and a second edge adjacent to a second region of the substrate that is covered by neither the intermediate layer nor the conductive layer;

a second land comprising the intermediate layer and the conductive layer, a first edge adjacent to the first region of substrate, and a second edge adjacent to the second region of substrate;

a bridge disposed between the first land and the second land comprising the intermediate layer and omitting the conductive layer, a first edge adjacent to the first region of substrate, and a second edge adjacent to the second region of substrate;

a first adhesion portion disposed over the first land and spanning between the first region of substrate and the second region of substrate;

a second adhesion portion disposed over the second land spanning between the first region of substrate and the second region of substrate; and a flyer layer adhered to the first adhesion portion and the second adhesion portion, disposed above the bridge relative to the substrate face, wherein the flyer layer spans the first land and the second land.

18. The chip slapper of claim 17, wherein the first adhesion portion and/or the second adhesion portion overlays a portion of the bridge.

19. The chip slapper of claim 17, wherein the intermediate layer comprises copper.

20. The chip slapper of claim 17, wherein the conductive layer comprises gold.

21. The chip slapper of claim 17, wherein the substrate comprises a ceramic material.

22. The chip slapper of claim 17, wherein the flyer layer comprises a polyimide material.

23. The chip slapper of claim 17, wherein the first and/or second adhesion portion comprises a metal oxide.

24. The chip slapper of claim 17, wherein the first and/or second adhesion portion comprises an electrical conductor.

25. The chip slapper of claim 17, wherein the first edges of the first land, the bridge, and the second land are substantially contiguous, and the second edges of the first land, the bridge, and the second land are substantially contiguous.

26. The chip slapper of claim 17, wherein the first adhesion portion and/or the second adhesion portion overlay a portion of the first substrate region and/or the second substrate region.

27. The chip slapper of claim 26, wherein the first adhesion portion and the second adhesion portion are substantially contiguous.

28. The chip slapper of claim 27, wherein the first adhesion portion and/or the second adhesion portion are formed of a non-conductive material.

29. The chip slapper of claim 17, further comprising a buffer layer disposed between the intermediate layer and the conductive layer.

* * * * *